United States Patent [19]

Owen

[11] 4,259,758

[45] Apr. 7, 1981

[54] METHOD OF MAKING A SELF-TAPPING SCREW

[75] Inventor: Kenneth R. Owen, Rockford, Mich.

[73] Assignee: Keeler Corporation, Grand Rapids, Mich.

[21] Appl. No.: 950,369

[22] Filed: Oct. 11, 1978

[51] Int. Cl.[3] ..... B21H 3/02

[52] U.S. Cl. ..... 10/10 R; 72/90

[58] Field of Search ..... 10/4, 10 R, 21, 27 R, 10/152 T; 72/88, 90, 469; 85/46, 48, 1 F, 1 L, 1 P, 1 SS, 41, 47; 151/22

[56] References Cited

U.S. PATENT DOCUMENTS

| | | | |
|---|---|---|---|
| 248,169 | 10/1881 | Harvey | 10/10 R |
| 288,798 | 11/1883 | Harvey | 10/10 R |
| 877,157 | 1/1908 | Allen | 10/10 R |
| 1,977,556 | 10/1934 | Hogue | 72/464 |
| 2,174,968 | 10/1939 | Cherry et al. | 10/4 |
| 2,239,352 | 4/1941 | Cherry | 10/10 R |
| 2,314,390 | 3/1943 | De Vellier | 10/10 R X |
| 2,314,391 | 3/1943 | De Vellier | 10/10 R X |
| 3,116,499 | 1/1964 | Friedman | 10/11 R |
| 3,117,473 | 1/1964 | Morton et al. | 72/90 |
| 3,398,625 | 8/1968 | Ansingh | 85/46 |
| 3,452,375 | 7/1969 | Gabbey | 10/10 R |
| 3,504,722 | 4/1970 | Breed | 151/22 |
| 3,517,542 | 6/1970 | Skierski | 72/469 |
| 3,772,720 | 11/1973 | Yamamoto | 10/10 R |
| 3,803,889 | 4/1974 | Muenchinger | 72/88 |
| 3,878,759 | 4/1975 | Carlson | 10/10 R X |
| 3,906,567 | 9/1975 | Barth et al. | 10/10 R |
| 4,040,328 | 8/1977 | Muenchinger | 10/10 R X |

FOREIGN PATENT DOCUMENTS

| | | | |
|---|---|---|---|
| 2516734 | 11/1975 | Fed. Rep. of Germany | 85/41 |

*Primary Examiner*—Ervin M. Combs

*Attorney, Agent, or Firm*—Price, Heneveld, Huizenga & Cooper

[57] ABSTRACT

A self-tapping screw of the type including a head, a depending cylindrical portion, a tapered point and a thread running continuously from the cylindrical portion onto the tapered point and a method of making same are disclosed. A screw blank is formed with a constant diameter cylindrical shank, the lower end of which includes a depression or concavity. Cooperating, relatively moving dies including opposed faces defining a tapered slot within which the blank is received cut a continuous thread into the blank. The concavity in the blank permits the metal to flow more readily resulting in crisp threads and a significant increase in the life of the thread rolling dies.

6 Claims, 8 Drawing Figures

METHOD OF MAKING A SELF-TAPPING SCREW

BACKGROUND OF THE INVENTION

The present invention relates to threaded fasteners and more particularly to a self-tapping screw and a method and apparatus for making same.

A wide variety of self-tapping screw forms are presently available. Self-tapping screws may be of the thread forming type, thread cutting type or the metallic drive type. The thread forming type self-tapping screws typically include a continuous thread and a tapered point. These screws are designed to plastically displace material adjacent to a pilot hole in order to form the threads which mate with the screw. Thread cutting type tapping screws include cutting edges and cavities or flutes. These types of screws physically remove material or cut the material adjacent the pilot hole to form the mating threads. Metallic drive screws are typically forced into the material to be joined by pressure. These types of screws are typically used where permanent fastenings are desired.

The various forms of tapping screws presently available have been standardized. The particular types of thread forms are typically designated ASA standards. For example, an ASA Type AB tapping screw form includes a shank portion having a spaced, continuous thread and which terminates in a gimlet point. A Type AB thread form is typically employed to join sheet metal, resin and impregnated plywood, wood and asbestos compositions. The gimlet point permits it to be used in pierced or punched holes where the sharp point may be necessary for starting of the thread forming. Another ASA type is designated Type B. This type of tapping screw form includes a cylindrical shank which terminates in a tapered, blunt-point. A spaced-thread screw is continuous on the shank and extends onto the blunt-point. The Type B thread form is typically designated for use in heavy-gauge sheet metal and nonferrous castings.

In the fabricating of tapping screws, a screw blank is typically fabricated from a cut length of wire stock. Typically, the stock is fabricated from a cold heading quality, annealed and processed low carbon steel. The cut length of stock is disposed within the bore of a male heading die and the lower end of the stock contacts a knock-out pin. A heading die or punch is moved into engagement with the end of the stock extending from the female die bore and deforms the stock to head the blank. In the fabrication of self-tapping screw forms wherein the lower end of the shank portion of the screw is tapered, the bore of the female heading die is formed with a taper so that the resulting blank includes a head and an integral, depending cylindrical shank portion which terminates in a tapered point having a circular cross section.

Typically, the screw blank will have the thread cut therein by a thread rolling machine. Thread rolling machines include complementary, relatively moving dies. Each die includes a face having a plurality of cutting ridges formed therein. The cutting ridges extend downwardly at an angle relative to the direction of die movement. The angle corresponds to the helix angle of the formed screw thread. The ridges are separated by grooves a distance which equals the pitch of the thread form. One of the dies is held stationary and the other die is reciprocated by the machine. The blank is received between the dies, is rolled between the relatively moving dies and the ridges cut the blank to form the thread formed therein. An example of a machine of this type may be found in U.S. Pat. No. 3,117,473, entitled THREAD ROLLING MACHINE and issued on Jan. 14, 1964 to R. D. Morton et al.

In the manufacture of self-tapping screws, especially those of the ASA Type B thread form, problems have been experienced with the service life of the heading dies, the service life of the thread cutting dies and with the attainment of good quality, continuous, crisp and sharp threads along the tapered portion of the screw. For example, formation of a tapered end in the shank of the screw blank results in excessive or high stresses being exerted on the female heading die. The female die at its tapered base will fracture due to the stress concentrations. Further, various methods used to roll the thread into the blanks have not resulted in formation of a good quality thread in the area of the taper. To increase thread quality, it has been proposed to employ dies having a straight, longitudinal section and an outwardly sloped or tapered section which will follow the taper on the shank of the blank in order to cut the threads. An example of dies which are configured to mate with the tapered portion on the shank of a blank may be found in U.S. Pat. No. 2,314,391, entitled SCREW AND ITS METHOD OF MANUFACTURE and issued on Mar. 23, 1943 to W. A. DeVellier. Another example of the prior approaches to the fabrication of self-tapping screws may be found in U.S. Pat. No. 3,772,720, entitled METHOD FOR MAKING A THREAD FORMING MEMBER and issued on Nov. 20, 1973, to Yoshio Yamamoto. Tapering of the thread cutting dies does not correct the problems which have heretofore been experienced with respect to failure of the heading dies employed to form the tapered shank screw blank.

If the screw blank is fabricated in a header die with a constant diameter shank portion to eliminate the fracture problems in the header dies, proper rolling of the threads and/or reliable service life of the dies will not be obtained. In order to properly form the tapered point on the self-tapping screws, the threading dies must define an outwardly sloping or tapered section which deforms the lower end of the shank in order to form the point and cut the threads therein. If the shank is of constant diameter in cross section, high stress concentrations occur at the sloped portions of the dies which can result in fracture and reduced service life for the dies.

SUMMARY OF THE INVENTION

In accordance with the present invention, a unique self-tapping screw and method and apparatus for making same are provided whereby the problems heretofore experienced with respect to proper thread formation, the attainment of a crisp cutting thread, fracture and reduced service life of the heading dies and the thread cutting dies are substantially eliminated. Essentially, the method includes the steps of forming a screw blank having a head and a cylindrical shank of constant diameter which terminates in an end formed with an outwardly opening depression, inwardly directed dimple or concavity. A thread continuously rolled or cut on the cylindrical shank by a pair of relatively reciprocating thread cutting dies. The dies are complementary and include opposed faces, each having an upper straight section, an intermediate tapered section and a lower straight section. A plurality of thread cutting ridges which are angled with respect to the direction of die movement are formed in the upper straight sections of the dies and at least some of the ridges extend into the tapered section of the die. When the threads are being cut into the shank due to the relative motion of the dies, the concavity permits the metal or material from which the blank is formed to flow more readily so that crisp threads are formed and the shank is tapered at its lower end.

In narrower aspects of the invention, the blank is formed by a pair of heading dies wherein the female heading die has a constant diameter bore and a knock-out pin which engages the stock, forms the concavity, depression or dimple in the end of the blank opposite the head. The screw which is roll formed by the method and apparatus in accordance with the present invention includes a shank having a cylindrical portion, a tapered lower end portion terminating in a depression, dimple or concavity and a continuous, crisp, well defined thread which extends along the shank and on to the tapered portion thereof. The screw in accordance with the present invention forms threads adjacent a pilot hole more easily and more uniformly than that heretofore obtained. When the screw in accordance with the present invention is case hardened, after formation of the thread, faster dissipation of heat in the concave area of the screw occurs during quenching, resulting in better hardening of that portion of the screw. The screw, therefore, has a hard point which increases the thread forming or cutting properties of the screw.

DETAILED DESCRIPTION OF THE PREFERRED EMBODIMENT

Figure 1:
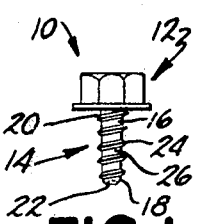
FIG. 1 is an illustration of a self-tapping, headed screw in accordance with the present invention.

A preferred embodiment of a self-tapping screw in accordance with the present invention is illustrated in FIG. 1 and generally designated 10. The screw 10 has an ASA Type B thread form and includes a hexagon washer head 12 and an integral shank 14. The shank 14 includes a cylindrical portion 16 of constant diameter and terminates in a tapered, blunt-point portion 18. A continuous, spaced thread 20 extends along the shank 14 from a point adjacent the head 12 onto the tapered portion 18. The shank 14 terminates at its end opposite the head 12 in an inwardly directed depression, dimple or concavity 22. The concavity 22 is aligned with the longitudinal axis of the shank 14. The threads 12 are crisp and well defined and formed along the cylindrical portion 16 and on to the tapered portion 18 of the shank 14. The thread crest 24 or the major diameter of the screw and the thread root 26 or the minor diameter of the screw will be of uniform dimensions along the cylindrical part of the screw. These dimensions, however, may become progressively smaller so that the difference between the major and minor diameters of the screw decrease along the tapered or work entering portion 18 of the screw 10.

Figure 2:
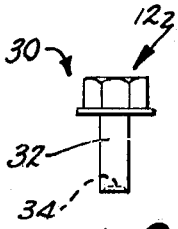
FIG. 2 is an illustration of a screw blank in accordance with the present invention from which the screw of FIG. 1 is formed.

The self-tapping screw 10 is formed from a screw blank generally designated 30 in FIG. 2. The blank 30 defines the head 12 and, as described in detail below, is formed with an elongated, constant diameter shank 32 integral with and coaxially aligned with the head 12. The shank 32 terminates in a downwardly opening or outwardly directed depression, dimple or concavity 34.

Figure 3:
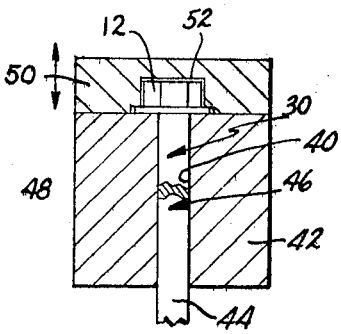
FIG. 3 is a schematic illustration of a heading die set of the type used to form the blank of FIG. 2.

As seen in FIG. 3, heading dies are used to fabricate the blank 30. A cut length of conventional screw grade wire stock is disposed within a constant diameter, cylindrical bore 40 defined by a female heading die 42. One end of the wire stock, when it is disposed within the bore 40, contacts the upper end 46 of a knock-out pin 44. The upper end 46 of the knock-out pin is formed with an outwardly tapered, blunt or truncated cone shaped portion 48. Movement of a heading punch or a punch die 50 having a concavity 52 onto the upper end of the stock deforms the stock to form the head 12 of the screw blank. This punching or relative movement of the dies toward each other also deforms the end of the stock in engagement with the upper end 48 of the knock-out pin 44. This results in the formation of the concavity 34 in the blank 30. The knock-out pin removes the formed blank from the female die in a conventional fashion.

Figure 6:
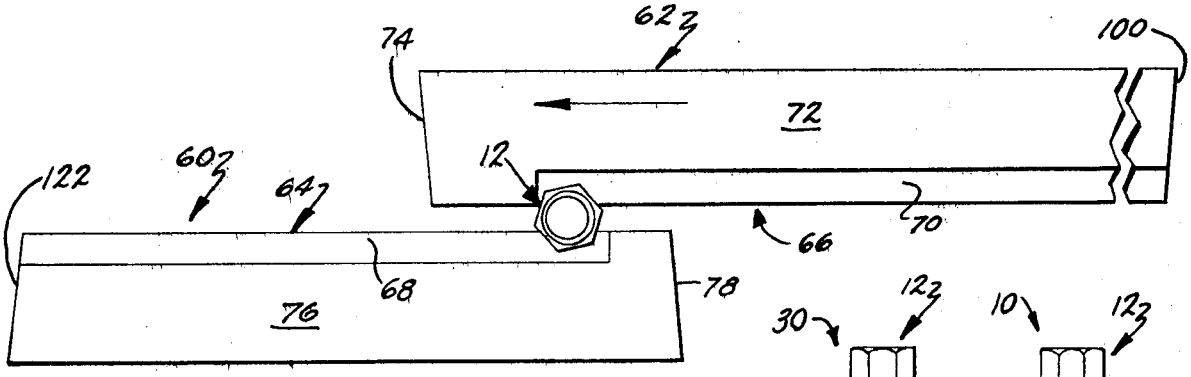
FIG. 6 is a plan view illustrating the positioning of the thread cutting dies and a blank during the formation of the threads in the blank.

As seen in FIG. 6, thread 20 is cut into the shank 32 of the blank 30 by a pair of relatively moving thread cutting and rolling dies 60, 62. The die 60, which is of the shorter longitudinal dimension, is held stationary in a conventional thread rolling machine. The die 62 is held in opposed relationship to the die 60 and is reciprocated by the roll forming machine past the die 60. Blank 30 is disposed between the opposed faces 64, 66 of the dies 60, 62, respectively.

Both dies 60, 62 include longitudinal extending complementary recesses 68, 70, respectively, machined into the upper surface of each die. Recess 70 on upper surface 72 of die 62 is formed at a point spaced from the work entering or leading edge 74 of the die. Similarly, recess 68 formed in upper surface 76 of die 60 is spaced from the work entering or leading edge 78 of the die. The recess permits, as explained in more detail below, the blank to move downwardly relative to the dies after initial cutting of the shank to prevent the head 12 from being pulled from the shank 32.

Figure 7:
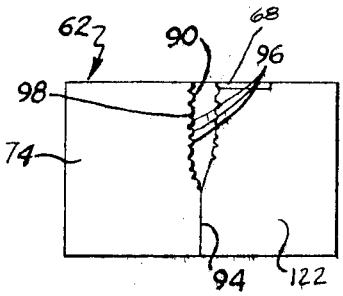
FIG. 7 is an end elevational view taken from the left side of FIG. 6 with the blank removed and the dies moved into contact.
Figure 8:
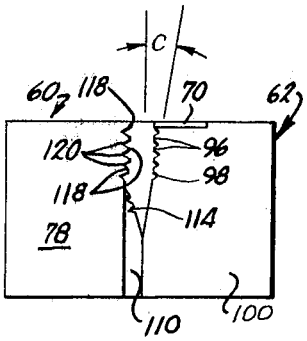
FIG. 8 is an end elevational view taken from the right side of FIG. 6 with the blank removed and the dies moved into contact.
Figure 5:
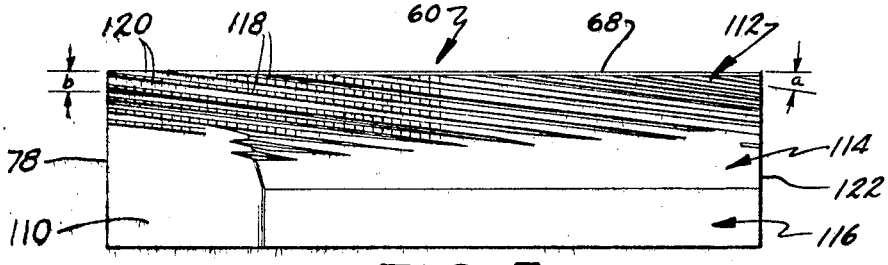
FIG. 5 is an elevational view of a thread cutting die in accordance with the present invention employed with the thread cutting die of FIG. 4.
Figure 4:
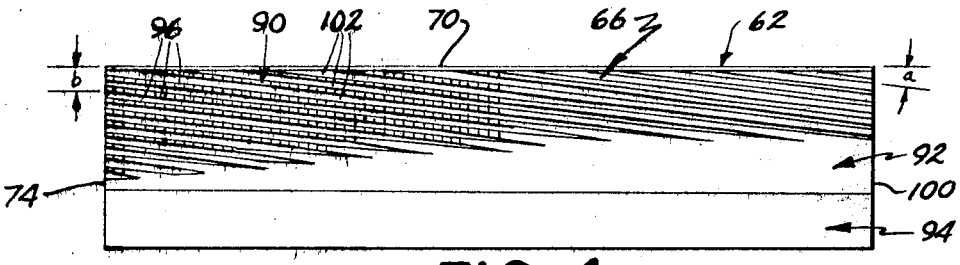
FIG. 4 is an elevational view of a thread cutting die in accordance with the present invention.

As seen in FIGS. 4, 7 and 8, the moving roll cutting die 62 longitudinally and vertically of its face 66 includes a first, straight section 90, an intermediate tapered section 92 and a lower, flat section 94. The intermediate tapered section or outwardly sloped section 92 is bounded by the upper or first straight section 90 and the lower or second straight section 94. Formed in the face 66 of the die 62 are a plurality of thread cutting ridges 96. The thread cutting ridges extend vertically and longitudinally of the face at an angle relative to the direction of movement of the die which is generally designated "a" in FIG. 4. The angle "a" corresponds to the helical angle of the formed thread 20 of the screw 10. Each of the ridges 96 extend parallel to each other and are spaced a distance designated "b" in FIG. 4 which corresponds to the pitch of the thread form 20. The ridges 96 are separated by grooves 98. The transverse dimension or width at the crest of the ridges increases from the leading or work receiving edge 74 of the die to the trailing or work release area 100 of the die. Also, the depth of the grooves 98 separating the cutting ridges 96 decreases from the work receiving end 68 to the work releasing end 100. The ridges 96 which extend along approximately one-half of the face 66 of the die 62 from edge 74 are formed with longitudinally spaced, transversely extending serrations 102. The serrations 102 engage and grip the shank 32 of the blank during the thread cutting operation to insure that the shank will roll with the die thereby preventing slippage, overheating and burning of the shank. The ridges 96 which begin adjacent the leading edge 74 of the die 62, as seen in FIG. 7, extend into the outwardly sloped or tapered portion 92 of the die face. The lowermost few of the ridges 96 adjacent this area of the die are smooth along their lengths, will bite and engage the shank material 32 and pull the material downwardly to form the frustoconical or truncated tapered portion 18 of the finished screw 10. Recesses 68, 70 on the dies prevent overstretching of the blank and possible head separation during this deformation of the blank.

The stationary die 60 along its face 64 defines a blank receiving recess 110 opening outwardly and extending longitudinally along a portion of the die from the work receiving edge 78. As with the die 62, die 60 also includes an upper or first straight or flat section 112, an intermediate, tapered or outwardly sloping section 114 and a lower or second straight section 116. The tapered section 114 complements tapered section 92. In a presently existing embodiment of the dies, the sections 92, 114 are tapered at an angle "c" of 8.5°.

The face 64 of die 60 includes a plurality of complementary, thread cutting ridges 118. The ridges extend downwardly at an angle relative to the direction of movement of the die 62 or at an angle relative to the longitudinal centerline of the die 60. The angle assumed by the ridges 118 corresponds to the angle assumed by the ridges 96. Similarly, the spacing between ridges 118 corresponds to the pitch of the thread form rolled by the dies in the shank 32. Ridges 118 are separated by grooves 120. The depths of the grooves decreases from the work receiving end 78 of the die to the work release or trailing end 122 of the die. Also, the transverse dimension or width of the crest of ridges 118 increases from the work receiving end 78 to the trailing end 122 of die 60. As with die 62, some of the ridges 120 extend into the tapered section 114 of the die face. This is seen, for example, in FIG. 7. The ridges 96 on die 62 and the ridges 120 on die 60 complement each other, roll a blank 30 positioned therebetween and cut the continuous thread 20 on the shank portion 32 of the blank 30. During the relative motion of the dies 60, 62, the tapered or outwardly sloping portions 92, 114 cooperate to pull the material adjacent the lower end of the shank 32 downwardly and to deform the material into the tapered point. The depression, concavity or dimple 34 permits the material to flow readily during such deformation and forming so that excessive stresses are not concentrated on the tapered or sloping portions of the relatively moving dies 60, 62. This results in a significant increase in die life. Also, the threads formed in the tapered portion are crisp and well defined. During the thread rolling operation, it is preferred that a lubricant be directed onto the blank and the faces of the dies. The use of a lubricant enhances the cutting operation and dissipates the heat generated thereby.

After the thread is cut into the shank 32 and the shank 32 is formed into the shank 16 of screw 10, the screw is then case hardened and heat treated. Due to the presence of the now deformed concavity or depression 22 in the completed screw form 10, less cross-sectional area is present at the blunt-point of the screw which results in better heat dissipation during the quenching operation. This results in increased hardness or better or more effective hardening of the point area of the screw 10. The point will be hardened to a greater extent than the cylindrical portion. As a result, the screw 10 more effectively and more easily forms the mating threads adjacent a pilot hole within which the screw is turned. Therefore, the screw 10 in accordance with the present invention, which is manufactured in accordance with the above described preferred method, is different from and more effective than prior self-tapping screws. The present invention increases the service life of the female heading die 42 since the die is formed with a constant diameter bore 40, thereby eliminating the stress concentrations associated with a tapered bore which has heretofore been employed. The present invention eliminates stress concentrations which would develop along tapered sections of the rolling dies if a straight, constant diameter blank were employed without the depression. Further, the present invention eliminates the need for special forming dies for swaging or deforming the ends of the screw blanks in order to provide sufficient metal and a proper configuration for forming of well defined threads along a tapered or conical blank portion of the self-tapping screw. As a result of the present invention, higher production rates, increased reliability and increased quality may be obtained.

It is expressly intended, however, that the above description should be considered as that of the preferred embodiment only. Various modifications will undoubtedly now become apparent to those of ordinary skill in the art which would not depart from the inventive concepts disclosed herein. For example, the specific dimensioning and configuration of the concavity 34 which has been illustrated as being of a truncated cone shape may be varied, it is believed, without affecting the overall results obtained. A sufficient dimple should be formed to provide a place for the metal to flow during thread formation. The dimple could also be formed after the blank heading step. Further, the inventive concepts disclosed herein may be employed to fabricate other types of self-tapping screws than the Type B embodiment specifically described. It is therefore intended that the true spirit and scope of the present invention may be determined by reference to the appended claims.

The embodiments of the invention in which an exclusive property or privilege is claimed are defined as follows.

1. A method of manufacturing a rolled thread tapping screw of the type including a head, a cylindrical portion, a tapered point and a thread running continuously from said cylindrical portion onto said tapered point, comprising the steps of:

forming a screw blank having a head and a cylindrical shank of constant diameter along its entire length, said shank terminating opposite said head in an end formed with an axially and outwardly directed concavity;

continuously rolling a thread on said cylindrical shank between a pair of relatively reciprocating, complementary dies, said dies being formed with opposed faces, each of said dies having an upper straight section and a tapered section, said dies each including a plurality of thread cutting ridges formed in said upper straight section, said ridges being separated by grooves and some of said ridges extending longitudinally of said dies and into said tapered section of each of said dies, one of said dies being held stationary and the other of said dies being moved past said one die to roll the thread onto said shank portion of said blank, and said step of forming said screw blank includes the steps of:

cutting a length of wire stock, said stock having a constant diameter throughout its length;

placing the cut length of stock into a female heading die, said female heading die defining a cylindrical bore having a constant diameter throughout its length;

contacting an end of said stock within said female heading die with a knock-out pin, said pin having a tapered end in engagement with said stock; and moving a heading punch into engagement with said stock to form a head on said stock and to cause said knock-out pin to form a concavity in the lower end of said stock whereby a screw blank having a constant diameter shank with a lower end having a concavity therein is formed.

2. A method as defined by claim 1 wherein each of said complementary dies has a leading edge from which a plurality of said ridges extend, the upper ones of said ridges including a plurality of longitudinally spaced transversely directed serrations for engaging said blank and preventing slippage of said blank relative to said complementary dies.

3. A method as defined by claim 2 wherein the lower ones of said ridges on said other of said complementary dies are smooth along their lengths and engage said blank along its lower end to pull the blank material downwardly to form a tapered blunt-point, said concavity permitting deformation of said blank without overstressing said dies along their intermediate tapered sections.

4. A method as defined by claim 3 wherein said rolling step further includes the step of lubricating said blank and the opposed faces of said complementary dies during the forming of the thread in said blank.

5. A method as defined by claim 4 wherein the tapered sections of each of said complementary dies are tapered from vertical at an angle of approximately 8.5°.

6. A method as defined by claim 4 further including the step of case hardening said screw after rolling the thread to harden the thread, the cylindrical portion and the tapered portion.

* * * * *